US010239661B2

(12) United States Patent
Plattner et al.

(10) Patent No.: US 10,239,661 B2
(45) Date of Patent: Mar. 26, 2019

(54) STACKABLE PLASTIC CONTAINER

(71) Applicant: GEORG UTZ HOLDING AG, Bremgarten (CH)

(72) Inventors: Patrik Plattner, Hermetschwil-Staffeln (CH); Boris Schwab, Endingen (CH)

(73) Assignee: Georg Utz Holding AG, Bremgarten (CH)

( * ) Notice: Subject to any disclaimer, the term of this patent is extended or adjusted under 35 U.S.C. 154(b) by 0 days.

(21) Appl. No.: 15/114,311

(22) PCT Filed: Jan. 28, 2015

(86) PCT No.: PCT/IB2015/050637

§ 371 (c)(1),
(2) Date: Jul. 26, 2016

(87) PCT Pub. No.: WO2015/114528

PCT Pub. Date: Aug. 6, 2015

(65) Prior Publication Data

US 2017/0001756 A1 Jan. 5, 2017

(30) Foreign Application Priority Data

Jan. 31, 2014 (CH) ..... 132/14

(51) Int. Cl.
*B65D 21/02* (2006.01)
*B65D 1/22* (2006.01)
*B65D 1/46* (2006.01)

(52) U.S. Cl.
CPC ..... *B65D 21/0213* (2013.01); *B65D 1/22* (2013.01); *B65D 1/46* (2013.01)

(58) Field of Classification Search
CPC ..... B65D 21/0213; B65D 1/46; B65D 1/22; B65D 21/2016

(Continued)

(56) References Cited

U.S. PATENT DOCUMENTS 3,508,679 A 4/1970 Semple
4,756,420 A * 7/1988 Deaton ..... B65D 1/22 206/514

(Continued)

FOREIGN PATENT DOCUMENTS

CH 683 087 1/1994
CH 686 360 3/1996

(Continued)

OTHER PUBLICATIONS

International Search Report issued by the European Patent Office in International Application PCT/IB2015/050637.

(Continued)

*Primary Examiner* — Andrew T Kirsch
*Assistant Examiner* — Don M Anderson
(74) *Attorney, Agent, or Firm* — Henry M. Feiereisen LLC

(57) ABSTRACT

A container for storage and transport of goods includes four sidewalls which surround a first planar bottom and have on their upper end a rim. A second bottom with a multiplicity of bottom ribs is connected to the first bottom by welding the bottom ribs of the second bottom with the first bottom. At least two opposite sidewalls of the container have each a projection which extends away from a sidewall and at a predetermined distance from the sidewall extends parallel to the sidewall in the direction of the bottom of the container. The projection has a horizontal end face which extends parallel to the area of the upper rim of the sidewall, with the horizontal end face extending at a level underneath the bottom plate of the first bottom.

9 Claims, 4 Drawing Sheets

(58) Field of Classification Search
USPC ..... 220/648, 646
See application file for complete search history.

(56) References Cited

U.S. PATENT DOCUMENTS

| | | | | |
|---|---|---|---|---|
| 8,739,706 | B2 | 6/2014 | Dubois et al. | |
| 8,950,342 | B2 | 2/2015 | Plattner | |
| 2001/0019063 | A1* | 9/2001 | Apps | B65D 1/22 220/771 |
| 2003/0024844 | A1* | 2/2003 | Hammett | B65D 1/22 206/505 |
| 2007/0007293 | A1* | 1/2007 | Sambrailo | B65D 1/22 220/366.1 |
| 2014/0117014 | A1 | 5/2014 | Schwab | |

FOREIGN PATENT DOCUMENTS

| | | |
|---|---|---|
| CN | 101049867 | 10/2007 |
| CN | 101233051 | 7/2008 |
| DE | 31 39 420 | 4/1983 |
| DE | 43 12 842 | 10/1994 |
| DE | 296 08 417 | 7/1996 |
| DE | 196 27 887 | 1/1998 |
| DE | 196 28 373 | 1/1998 |
| DE | 203 15 302 | 2/2004 |
| DE | 102009055245 | 6/2011 |
| EP | 0 621 190 | 10/1994 |
| EP | 0 818 394 | 1/1998 |
| EP | 2 338 799 | 6/2011 |
| WO | WO2010/122129 A1 * | 4/2010 |
| WO | WO 2011/120641 | 6/2011 |

OTHER PUBLICATIONS

Swiss Search Report issued by the Swiss Patent Office in Swiss Application No. CH 00132/14.
English translation of Swiss Search Report issued by the Swiss Patent Office in Swiss Application No. CH 00132/14.
Chinese Search Report dated Apr. 14, 2017 with respect to counterpart Chinese patent application 201580005059.2.
Translation of Chinese Search Report idated Apr. 14, 2017 with respect to counterpart Chinese patent application 201580005059.2.

* cited by examiner

STACKABLE PLASTIC CONTAINER

CROSS-REFERENCES TO RELATED APPLICATIONS

This application is the U.S. National Stage of International Application No. PCT/IB2015/050637, filed Jan. 28, 2015, which designated the United States and has been published as International Publication No. WO 2015/114528 and which claims the priority of Swiss Patent Application, Serial No. 00132/14, filed Jan. 31, 2014, pursuant to 35 U.S.C. 119(a)-(d).

BACKGROUND OF THE INVENTION.

Technical Field

The invention refers to a container for the storage and transport of goods. In particular, it refers to such a container which is configured with a double bottom and which is made of plastic and is stackable.

State of the Art

For purposes of strengthening the bottom and the transport of heavy goods, containers for goods are manufactured with a double bottom. CH 686 360 discloses a plastic container with a second bottom which is attached through welding. For this purpose, a second ribbed bottom is welded to a planar first bottom. As an alternative, a second planar bottom is welded to a first bottom having protruding ribs. In a further variant, both the first and second bottoms are provided with ribs, with both bottoms being welded together rib on rib.

In order to enable stacking of such plastic containers, the containers have at the upper end of the sidewalls as well as at a level to the first bottom stacking rims which protrude from the sidewalls, These rims allow for stacking of the containers by placing a stacking rim at a level with the bottom of a container upon the rim at the end of the sidewalls of another container and nesting the two containers within one another.

DESCRIPTION OF THE INVENTION

Object of the invention is to provide a container of plastic which can be stacked onto another container of the same kind as flush as possible and to thereby realize a stack that is as stable as possible.

This object is solved according to the present invention by a container including four sidewalls which surround a first bottom with a planar bottom plate and have a rim at their upper end. A second bottom with a plurality of ribs is connected to the planar bottom plate of the first bottom, with the ribs of the second bottom being welded to the planar bottom plate of the first bottom. According to the invention, at least two opposite sidewalls have each a projection which extends away from the sidewall. At a predefined distance from the sidewall, the projection then extends parallel to the sidewall in the direction of the bottom of the container beyond the first planar bottom plate and beyond the welded joints between the first and second bottoms. The projection has a horizontal end face which runs parallel to the surface area of the upper rim of the sidewall, with the horizontal end face extending from the bottom plate of the first bottom to a level below the first bottom. The horizontal end face of the projection extends hereby not only to a level below the planar bottom plate of the first bottom, but also to a level below the welded joints and between the first bottom and the lowermost dimension of the bottom ribs of the second bottom.

The projection according to the invention on the sidewalls enables a securement of the container on a container of the same kind when stacking, by placing the projection upon the upper rim of the sidewalls. As a result, the horizontal end faces of the projection rest on the rim of the sidewalls. The second bottom of the container is hereby disposed within the rim, so that the second bottom fits flush in the lower container and the container is unable to slide in relation to the lower container. For this purpose, the projection preferably extends to a distance away from the sidewall which is equal to the width of the rim of the sidewall.

By extending the projection beyond the welded joints to a level which is between the first bottom plate and the lowermost part of the second bottom, these welded joints become concealed. In particular, a protruding mostly unevenly formed bead is hereby concealed which may develop during welding, in particular during vibration welding. Due to the horizontal end faces in parallel relation to the rims of the sidewalls, a straight stacking is ensured. The projection according to the invention particularly prevents the container from bearing against these beads, when stacking, which would cause a tilted and uneven stacking.

The projection according to the invention not only guarantees a straight even stacking of the containers, but also avoids costly refinishing works of the welded joints in order to remove the welding beads and to realize a straight abutment of the container rims.

Preferably, the projection according to the invention is part of a container produced in one piece, i.e., of the container with sidewalls and the first planar bottom plate.

The container can be manufactured, for example, by injection molding.

The solution with the projection according to the invention is characterized by the simple shape of the elements as well as their simple configuration.

In one embodiment of the invention, the projection is implemented on all four sidewalls.

In a further embodiment of the invention, the projection has on opposite sidewalls at least two ribs, which respectively terminate perpendicular to the sidewalls and at their lower end in a horizontal edge which extends parallel to the rim of the sidewall. The end edges of the at least two ribs form hereby the horizontal end face of the projection.

In a further embodiment of the invention, the projection has on all four sidewalls at least one rib, which extends perpendicular to the sidewalls and terminates at its lower end in a horizontal edge which runs parallel to the rim of the sidewall.

In a further embodiment of the invention, the individual ribs of the projection are connected by a cover which extends along the sidewall. The cover respectively extends from the sidewall up to the outermost dimension of the ribs. In a further embodiment, the cover extends downwards to the end edge of the ribs.

The projection according to the invention enables a simple and precise stacking of the containers, with the stacking being independent of the configuration of the second bottom. This enables a wide variety of various second bottoms, while the containers can simply and precisely stacked at the same time.

In an embodiment of the invention, the second ribbed bottom has a bottom area which is configured evenly across the entire area of the container bottom.

In a further embodiment of the invention, the second ribbed bottom has a bottom area which has an indentation across a predetermined area in the center of the container, whereas the remaining area of the second ribbed bottom is configured planar along the sidewalls. The indentation of the second bottom is hereby realized on the second bottom by ribs which are sized shorter in the center of the bottom than ribs along the sides of the second bottom. As a result, the container rests on the lateral region of the second bottom with the longer ribs at all times. In the central region of the bottom with the shorter ribs and the contact surface, a clearance is established. The indentation in the second bottom prevents an uneven placement of the container when a very heavy load is involved. In the presence of a heavy load, the bottom sags and moves hereby into the clearance of the indentation. However, the container still rests on the planar contact surface along the sides. The indentation thereby prevents an uneven placement of the container, even though the bottom sags.

In a further embodiment of the invention, the second ribbed bottom has a slant on two opposite sides. For this purpose, the ribs of the second bottom are each formed increasingly shorter towards the sides, so that the second bottom becomes increasingly thinner towards the rim of the bottom. The slant enables easier transport of the container across rollers of a conveyor belt and prevents queuing or bumping of the containers, when being transferred from one conveyor belt to a next conveyor belt.

Thanks to the projection according to the invention, the embodiments of the container with differently shaped second bottoms are all precisely stackable as the embodiment with the planar second bottom. Further advantages of the invention become apparent from the following description, in which an exemplary embodiment of the invention is described in greater detail with reference to the schematic drawings.

BRIEF DESCRIPTION OF THE FIGURES

It is shown in.

Same reference signs are used in the figures for the same elements, and first-time explanations relate to all figures, unless expressly noted otherwise.

EXEMPLARY EMBODIMENTS OF THE INVENTION

Figure 1:
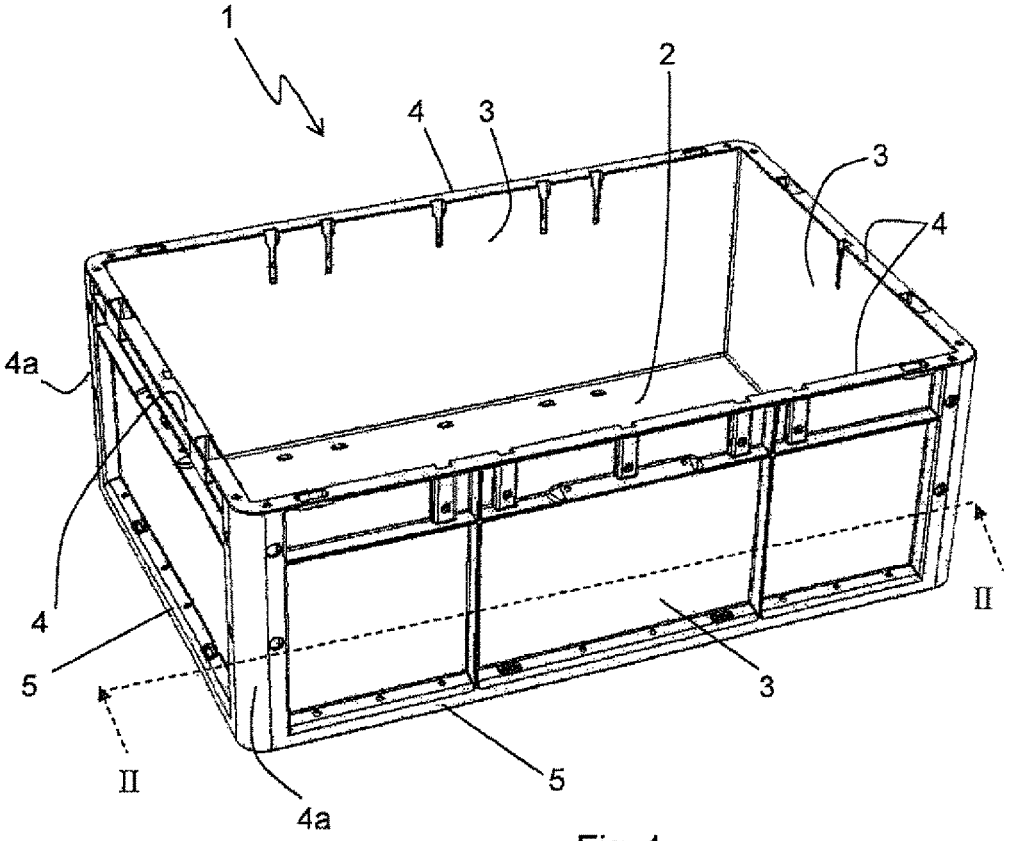
FIG. 1 an overall perspective view of the container according to the invention with projection on the sidewalls, FIG. 2*a* a cross sectional view of the container according to the invention along II-II in FIG. 1, FIG. 2*b* a view of the container in a cross section as in FIG. 2*a*, however, by way of a slightly perspective view.

FIG. 1 shows a container 1 by which the invention can be realized. It includes a bottom 2 and four surrounding sidewalls 3, each having an outwardly protruding upper rim. The rim 4 is intended for stacking of several containers 1 on top of each other. A corner element 4*a* extends at each of the corners of the container 1 and runs from the outermost dimension of the rim 4 downwards toward the bottom.

Figure 2A:
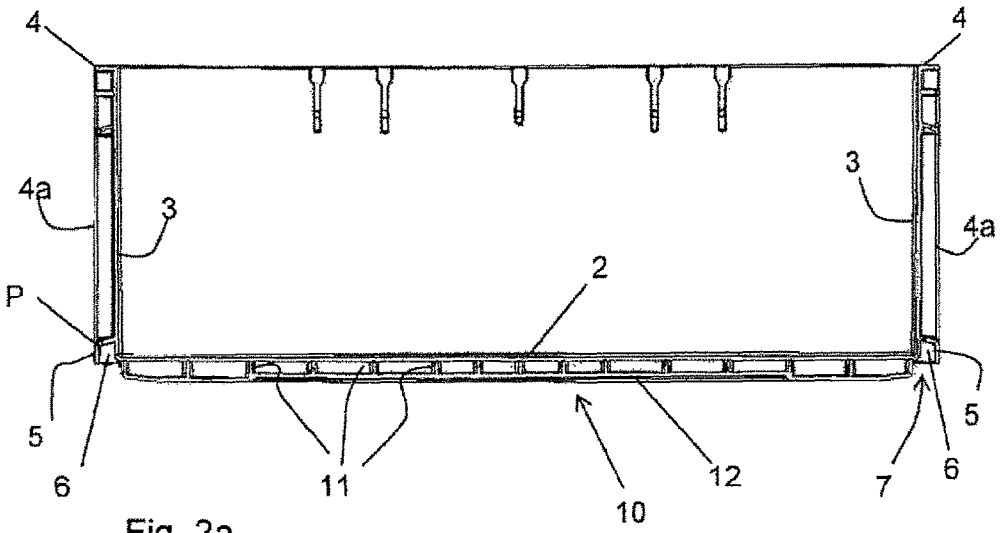
Figure 2B:
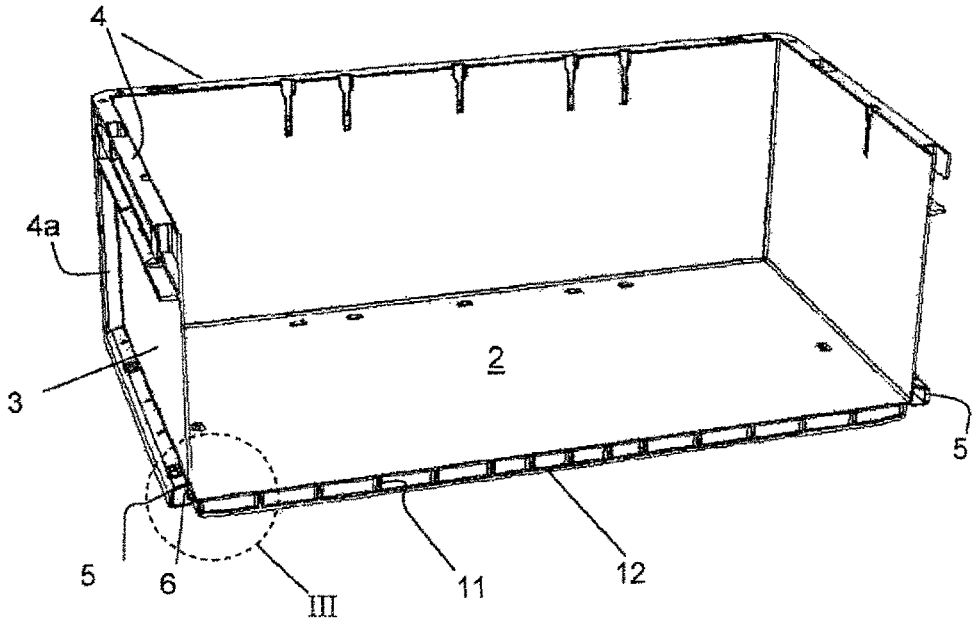

According to the cross sectional views of FIGS. 2*a* and 2*b*, the container 1 has a projection 5 with ribs 6 on each of opposite sidewalls 3. The projection 5 and the ribs 6 initially extend from the sidewalls 3 at an angle in a slight slant downwards to a point P which is located vertically under the outer dimension of the rim 4. The Figure shows a corner edge 4*a* which coincides with the vertical downward line from the rim 4. The rib 6 terminates below with an end edge 7 which extends horizontally, i.e., perpendicular to the sidewall 3 and parallel to the upper rim 4. These end edges 7 form the horizontal end face of the projection according to the invention.

Figure 3:
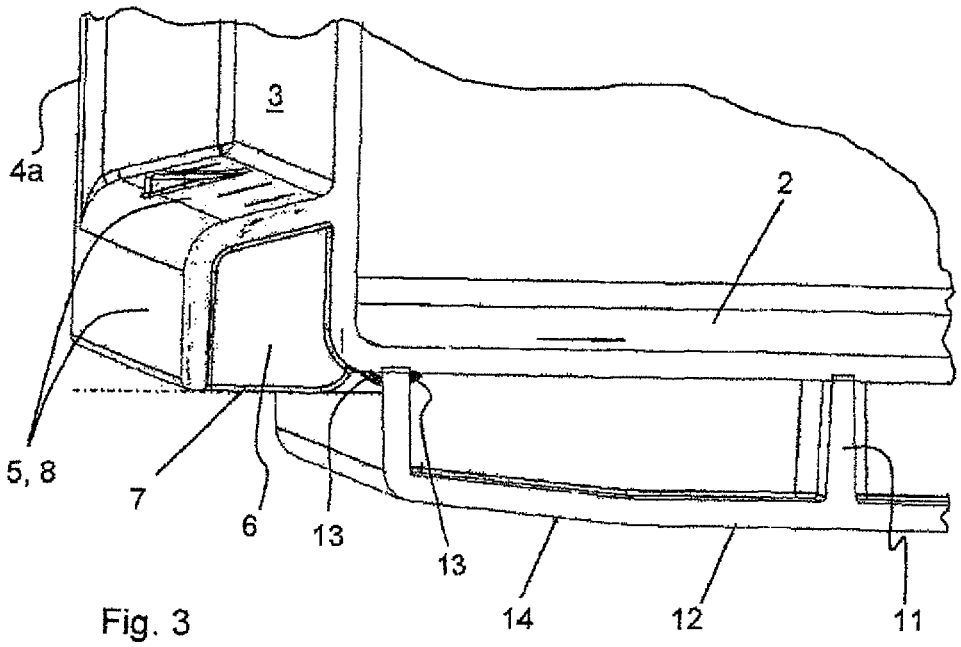
FIG. 3 a detailed view of the projection according to the invention on the container according to the invention according to Ill in FIG. 2*b*, FIG. 4 a bottom view of the container bottom, in particular the indentation and the slanted parts, FIG. 5 a bottom view of a detail of the container bottom plate according to V in FIG. 4, in particular the ribs of the projection, FIG. 6 a closer view of the projection of FIG. 5, in particular of the cover of the welded joint between the first and second bottoms of the container.

The bottom 2 of the container 1 is configured planar, in particular planar at the lower side. A second reinforcing bottom 10 is welded to the lower side of the bottom 2 and has several bottom ribs 11 and a bottom plate 12. Weld joints are located at the points of contact between the bottom ribs 11 and the first planar bottom 2 and typically have a bead 13 of 1-2 mm about the bottom rib 11 and at the bottom 2, as shown in FIG. 3. The rib 6 of the projection 5 extends in accordance with the invention perpendicular away from the sidewall 3 and downward in a vertical direction up to a level below the welded joint between the first bottom 2 and the ribs 11 of the second bottom 10. The end faces 7 of the projection extend at a level between the first bottom and the lowermost dimension of the second bottom, i.e. in the shown example between the first bottom and the bottom plate 12 of the second bottom. The end edge 7 thus extends at a level below the bottom plate 2 and below the bead 13, as illustrated in detail in FIG. 3 by way of the dashed line. As a result of this vertical dimension, the bead 13 is concealed, so that the end edges 7 of the ribs 6 rest upon the rim 4 and the bead 13 is located in a clearance in the absence of a contact with the lower container, when the container 1 is stacked upon the upper rim 4 of a container 1 of the same kind.

Figure 4:
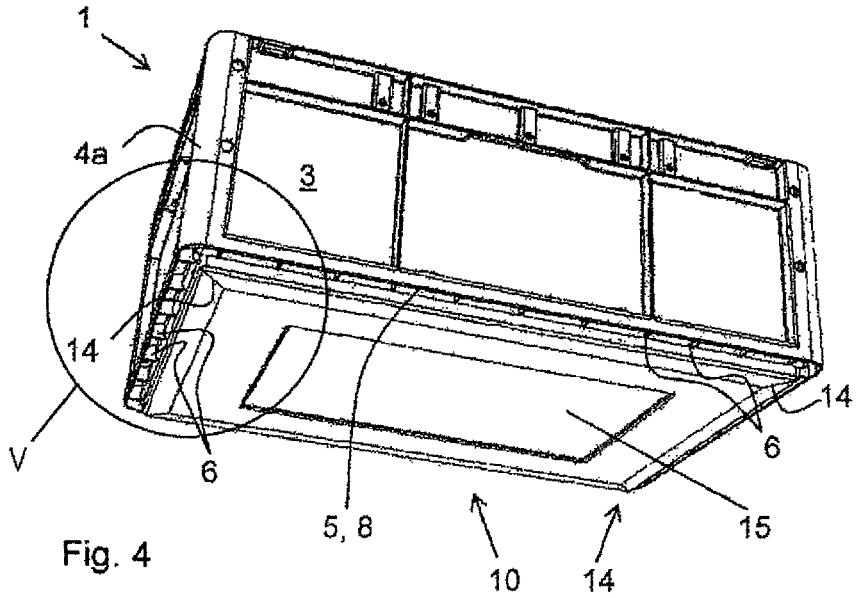

FIG. 4 shows the arrangement of the projection 5, which extends about the entire container 1, with a plurality of ribs 6 on all the sidewalls 3 of the container, with a minimum of one rib per side being necessary. Preferably, the projection has two or more ribs per side.

This measure of the projection 5 and particularly its vertical dimension enables different shapes of the second bottom 10, with the ribs 6 and the rim 4 ensuring at all times a straight stacking of the containers. An exemplary shape of a second bottom 10 is shown in FIGS. 3 and 4. The bottom 10 has in the region along the sides a circumferential slant 14 which extends from the border of the bottom downwards towards the center. This enables an even transport of the containers across transitions, like for example rollers between conveyor belts, entry upon the conveyor belts or exits from the conveyor belts. In midsection, the bottom 10 has an indentation 15 which provides a clearance. This clearance is able to receive a sagging of the midsection of the bottom, without the midsection touching the area which supports the container. Thus, a possible tilting of the container is prevented.

In the example of FIGS. 3 and 4, several ribs 6 of the projection 5 are shown on each side of the container 1. The function of the projection as stacking support is already ensured by way of one rib 6 per side, when a projection is present on all four sides. In the shown example, the projection is realized with several ribs 6 and thus is stronger and more robust.

In addition, the ribs 6 are connected with each other, for example, by a cover 8, which extends between two corner elements 4*a*. The cover 8 provides reinforcement of the stacking support and protection of the ribs 6 from impacts.

Figure 5:
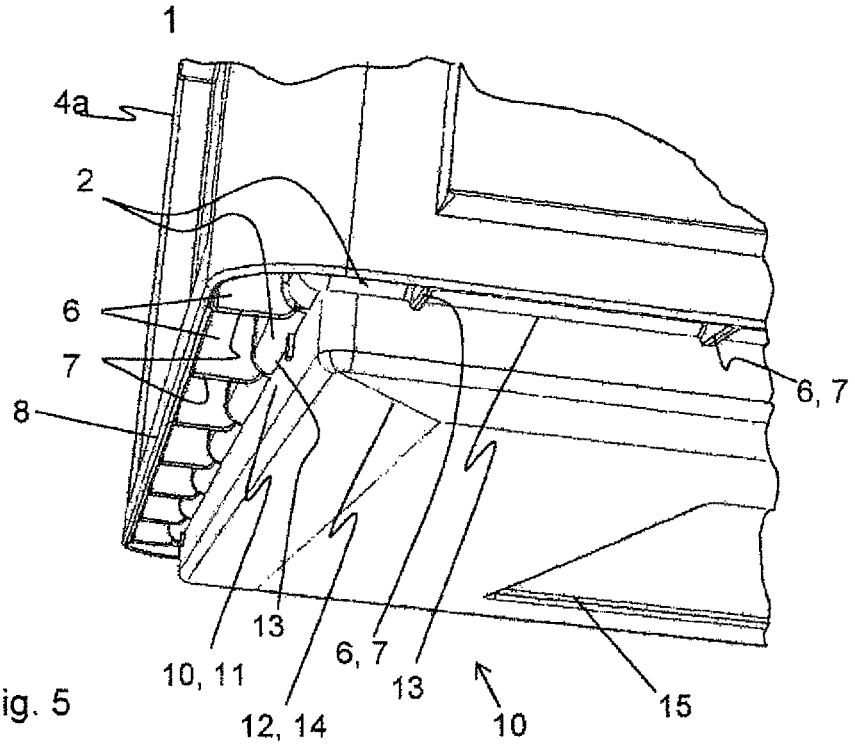
Figure 6:
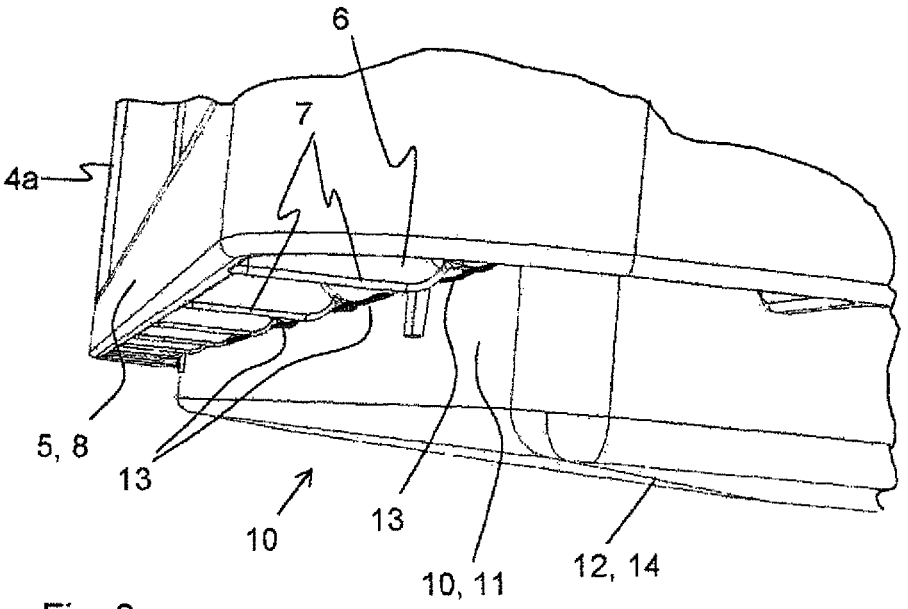

FIGS. 5 and 6 show in more detail the arrangement of the ribs 6 of the projection 5 according to the invention, with the vertical dimension of the ribs 6 and the position of the horizontal end edges 7 relative to the welded joints at the bottoms 2 and 10 being illustrated in particular. The end edges 7 extend at a level that is lower than the welded joint 13 between the upper first bottom 2 and the second lower bottom 10, i.e. the bottom ribs 11. The bead 13 at the welded joint is hereby situated in a recess between the end edges 7 and the bottom 2. When the container is stacked by placing the ribs 6 upon the rim 4 of a container, the bead 13 remains in the clearance of the recess and is not part of the contact or support surface of the stacked container.

The invention claimed is:

1. A container for the storage and the transport of goods, said container comprising:

a planar first bottom including a bottom plate;

four sidewalls in surrounding relationship to the first planar bottom, each said sidewall having an upper end to form a rim; and a second bottom including a plurality of bottom ribs and connected to the first bottom by welding the bottom ribs with the first bottom, at least two opposite ones of the sidewalls having each a projection which extends away from the sidewall and extends at a predetermined distance from the sidewall in parallel relation to the sidewall in a direction of the first and second bottoms, said projection having a horizontal end face extending directly outwardly from and substantially parallel to the planar first bottom and in parallel relationship to an area of the rim of the sidewall, said horizontal end face extending from the planar first bottom at a level below the bottom plate of the first bottom and lower than a welded joint between the bottom ribs and the first bottom to thereby conceal the welded joint, wherein the horizontal end face of the projection extends at a level between the first bottom and a lowermost dimension of the bottom ribs of the second bottom.

2. The container of claim 1, wherein the second bottom has a bottom plate, said horizontal end face of the projection extending at a level between the first bottom and the bottom plate of the second bottom.

3. The container of claim 1, wherein the projection includes at least two ribs which run perpendicular to the sidewall and to a lower end of the projection and which terminate at the lower end in the horizontal end face which extends parallel to the rim of the sidewall.

4. The container of claim 1, wherein each of the sidewalls includes a said projection having at least one rib.

5. The container of claim 1, wherein the projection is made in one piece with the first bottom and the sidewall.

6. The container of claim 3, further comprising a cover which extends along the sidewall, said ribs of the projection being connected by the cover.

7. The container of claim 1, wherein the second bottom has a bottom area which is configured planar across an entire area of the second bottom.

8. The container of claim 1, wherein the second bottom has a bottom area provided with an indentation across a predetermined area in a center of the second bottom.

9. The container of claim 1, wherein the second bottom has a slant on two opposite sides.

* * * * *